US007890242B2

(12) United States Patent
Kondou et al.

(10) Patent No.: US 7,890,242 B2
(45) Date of Patent: Feb. 15, 2011

(54) INTERNAL COMBUSTION ENGINE AND METHOD OF CONTROLLING THE SAME

(75) Inventors: Shinya Kondou, Gotemba (JP); Yasuhiro Oi, Numazu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 11 days.

(21) Appl. No.: 12/443,506

(22) PCT Filed: Nov. 30, 2007

(86) PCT No.: PCT/IB2007/003689

§ 371 (c)(1),
(2), (4) Date: Mar. 30, 2009

(87) PCT Pub. No.: WO2008/072049

PCT Pub. Date: Jun. 19, 2008

(65) Prior Publication Data

US 2010/0028167 A1 Feb. 4, 2010

(30) Foreign Application Priority Data

Dec. 13, 2006 (JP) ..... 2006-335814

(51) Int. Cl.
*F02M 7/28* (2006.01)

(52) U.S. Cl. ..... 701/107; 123/435

(58) Field of Classification Search ..... 701/107; 73/35.12, 114.16, 114.18; 123/435, 406.49, 123/406.53

See application file for complete search history.

(56) References Cited

U.S. PATENT DOCUMENTS

| | | | | |
|---|---|---|---|---|
| 6,211,681 | B1 * | 4/2001 | Kagawa et al. | 324/426 |
| 6,626,154 | B1 | 9/2003 | Kanno | |
| 6,965,825 | B2 * | 11/2005 | Hosoya et al. | 701/114 |
| 7,073,323 | B2 | 7/2006 | Hirooka et al. | |
| 7,698,931 | B2 * | 4/2010 | Hanari et al. | 73/114.43 |
| 2003/0061805 | A1 | 4/2003 | Hirooka et al. | |
| 2006/0048504 | A1 | 3/2006 | Oi et al. | |

FOREIGN PATENT DOCUMENTS

| | | |
|---|---|---|
| EP | 1 293 648 | 3/2003 |
| JP | 1 208542 | 8/1989 |
| JP | 10 18893 | 1/1998 |
| JP | 2003 83048 | 3/2003 |
| JP | 2006 70835 | 3/2006 |
| JP | 2006 329003 | 12/2006 |

* cited by examiner

*Primary Examiner*—Hai H Huynh
(74) *Attorney, Agent, or Firm*—Oblon, Spivak, McClelland, Maier & Neustadt, L.L.P.

(57) ABSTRACT

Immediately after startup of the engine, secondary air is supplied by an air pump into each exhaust branch passage via a secondary-air supply passage. A pressure sensor is disposed in the secondary-air supply passage. An output voltage of the pressure sensor decreases as the battery voltage decreases. When the battery voltage is lower than a permissible voltage, the output value of the pressure sensor is inhibited from being used as an output value representing the pressure. Thus, atmospheric pressure can be accurately detected.

18 Claims, 8 Drawing Sheets

INTERNAL COMBUSTION ENGINE AND METHOD OF CONTROLLING THE SAME

BACKGROUND OF THE INVENTION

1. Field of the Invention

The invention relates to an internal combustion engine and a method of controlling the internal combustion engine.

2. Description of the Related Art

In an internal combustion engine having a secondary-air supply passage connected to an engine exhaust passage, and an air pump for supplying secondary air into the engine exhaust passage via the secondary-air supply passage, a pressure sensor for detecting an absolute pressure in the secondary-air supply passage is disposed in the secondary-air supply passage, and fault diagnosis of a secondary-air supply control device is performed based on an output value of the pressure sensor, as disclosed in, for example, Japanese Patent Application Publication No. 2003-83048 (JP-A-2003-83048).

In the internal combustion engine as described above, fault diagnosis is performed based on the magnitude of the pressure in the secondary-air supply passage relative to atmospheric pressure, and it is, therefore, necessary to detect in advance an output value of the pressure sensor representing atmospheric pressure. Also, since the fault diagnosis is carried out immediately after supply of secondary air is started after startup of the engine, the output value of the pressure sensor representing atmospheric pressure must be detected when or before the engine is started. Accordingly, a controller of the engine as described above stores an output value of the pressure sensor detected immediately before startup of the engine, as an output value representing atmospheric pressure.

In the meantime, a battery voltage is applied from a battery to the pressure sensor, and the output value of the pressure sensor decreases as the battery voltage decreases even if the sensor detects the same atmospheric pressure. On the other hand, immediately before startup of the engine, a starter motor or other accessories having a high electric load may be actuated or started. If the starter motor and/or other accessories of a high electric load is/are actuated while the battery is in deteriorated condition, the battery voltage may be reduced. Accordingly, if the output value of the pressure sensor obtained immediately before startup of the engine is simply stored as the output value representing atmospheric pressure while the battery voltage is reduced, as in the above-described engine, there arises a problem that the stored output value of the pressure sensor does not actually represent the atmospheric pressure.

SUMMARY OF THE INVENTION

The invention provides an internal combustion engine and its control method that can avoid erroneous detection of faults of a secondary-air supply control device even in the case where the battery is in deteriorated condition.

A first aspect of the invention relates to an internal combustion engine including a battery and a pressure sensor to which a battery voltage is applied from the battery and which produces an output responsive to a pressure, wherein an output value of the pressure sensor changes in accordance with a reduction in the battery voltage. In this engine, the output value of the pressure sensor is inhibited from being used as an output value representing the pressure, when the battery voltage is lower than a predetermined permissible voltage.

A second aspect of the invention relates a method of controlling an internal combustion engine including a battery and a pressure sensor to which a battery voltage is applied from the battery and which produces an output responsive to a pressure, wherein an output value of the pressure sensor changes in accordance with a reduction in the battery voltage. According to this method, the output value of the pressure sensor is inhibited from being used as an output value representing the pressure when the battery voltage is lower than a predetermined permissible voltage.

According to the first and second aspects of the invention, an erroneous output value of the pressure sensor is prevented from being used as an output value representing the pressure to be detected.

BRIEF DESCRIPTION OF THE DRAWINGS

The foregoing and further features and advantages of the invention will become apparent from the following description of exemplary embodiments with reference to the accompanying drawings, wherein like numerals are used to represent like elements, and wherein.

DETAILED DESCRIPTION OF EMBODIMENTS

Figure 1:
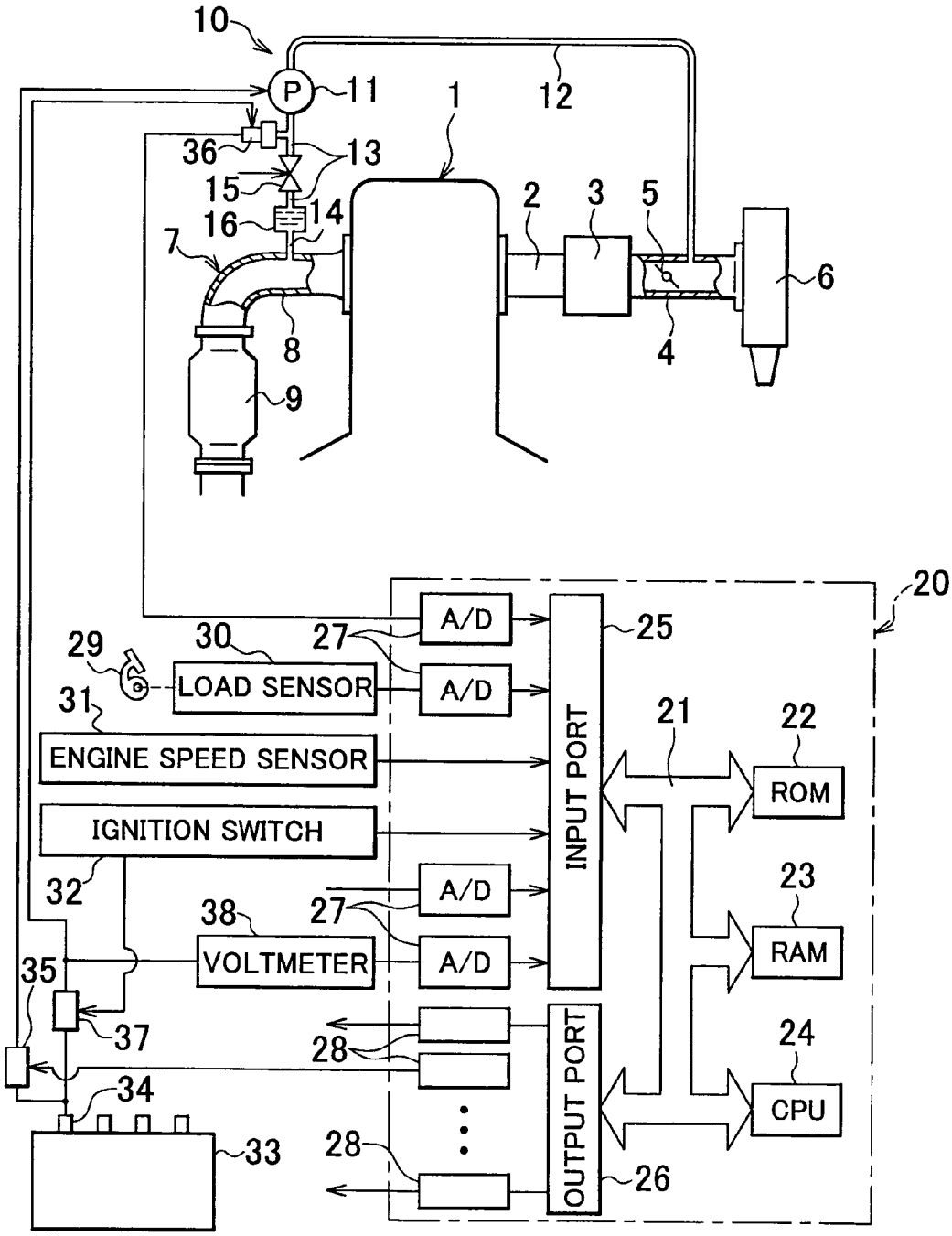
FIG. 1 is a view showing the whole system of an internal combustion engine.

FIG. 1 shows the whole system of an internal combustion engine according to one embodiment of the invention. The internal combustion engine includes an engine body 1, an intake manifold 2, a surge tank 3, an intake duct 4, a throttle valve 5 disposed in the intake duct 4, and an air cleaner 6. The engine further includes an exhaust manifold 7 having a plurality of exhaust branch pipes 8 coupled to respective cylinders, a catalytic converter 9 coupled to an exhaust collecting portion of the exhaust manifold 7, and a secondary-air supply control device 10.

The secondary-air supply control device 10 includes an air pump 11 adapted to be driven by an electric motor. An air inlet port of the air pump 11 is connected to a portion of the intake duct 4 upstream of the throttle valve 5 via a secondary-air inlet passage 12, and an air discharge port of the air pump 11 is connected to exhaust passages in the respective exhaust branch pipes 8 via a common secondary-air supply passage 13 and secondary-air supply branch passages 14 that branch off from the secondary-air supply passage 13. A switch valve 15 and a reed valve 16 are disposed in the secondary-air supply passage 13 in this order as viewed in the direction from the air pump 11 to the exhaust branch pipes 8. The reed valve 16 allows flow of air from the switch valve 15 into the exhaust branch pipes 8.

An electronic control unit 20 consists of a digital computer, and includes ROM (read-only memory) 22, RAM (random access memory) 23, CPU (microprocessor) 24, an input port 25 and an output port 26, which are connected to each other via a two-way bus 21. A load sensor 30 connected to an accelerator pedal 29 produces an output voltage proportional to the amount L of depression of the accelerator pedal 29, and the output voltage of the load sensor 30 is transmitted to the input port 25 via a corresponding A/D converter 27. To the input port 25 is also connected an engine speed sensor 31 that produces an output pulse each time the crankshaft rotates by, for example, 30°. The input port 25 also receives an ON/OFF signal from an ignition switch 32.

As shown in FIG. 1, terminals 34 of a battery 33 are connected to the air pump 11 via a relay 35. When the relay 35 is switched to a conducting state, a battery voltage is applied to the air pump 11 so as to drive the air pump 11. Meanwhile, a pressure sensor 36 for detecting an absolute pressure in the secondary-air supply passage 13 is disposed in a portion of the secondary-air supply passage 13 between the air pump 11 and the switch valve 15. The pressure sensor 36 is connected to the terminals 34 of the battery 33 via a switch 37 that is brought into a conducting state when, for example, the ignition switch 32 is turned on. With this arrangement, when the ignition switch 32 is turned on, a battery voltage is applied to the pressure sensor 36.

An output voltage of the pressure sensor 36 is transmitted to the input port 25 via a corresponding A/D converter 27. A voltmeter 38, which is connected to the terminals 34 of the battery 33, serves to detect the battery voltage when the ignition switch 32 is turned on. The output signal of the voltmeter 38 is transmitted to the input port 25 via a corresponding A/D converter 27. On the other hand, the output port 26 is connected to the switch valve 15, relay 35, and other components via corresponding drive circuits 28.

Figure 2:
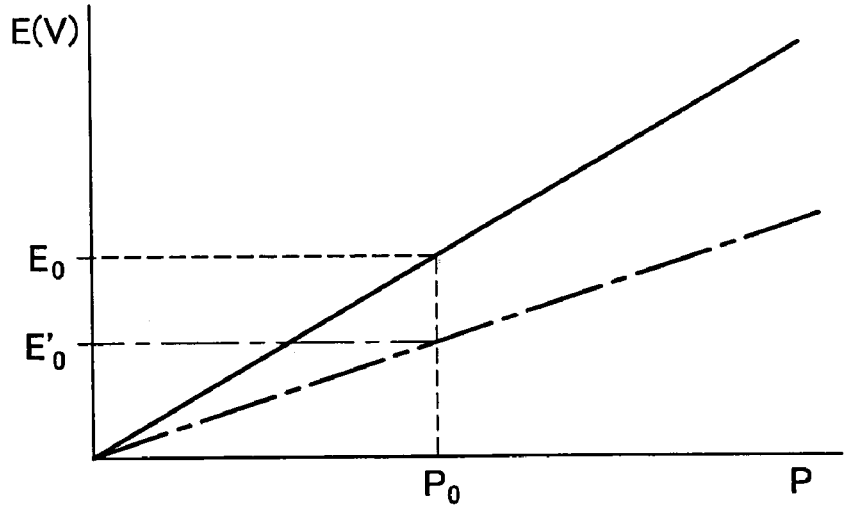
FIG. 2 is a graph showing the relationship between an output voltage E of a pressure sensor and an absolute pressure P.

In FIG. 2, the solid line indicates the relationship between the output voltage E (V) of the pressure sensor 36 obtained when the battery voltage is equal to a nominal battery voltage, and the absolute pressure P in the secondary-air supply passage 13, which is applied to the pressure sensor 36. On the other hand, the chain line in FIG. 2 indicates the relationship between the output voltage E of the pressure sensor 36 obtained when the battery voltage is reduced, and the absolute pressure P. As is understood from FIG. 2, if the battery voltage is reduced, the output voltage E decreases from $E_0$ to $E_0'$ even though the absolute pressure P is equal to the same pressure level $P_0$. Namely, the output voltage E of the pressure sensor 36, which represents atmospheric pressure, decreases as the battery voltage decreases.

Figure 3:
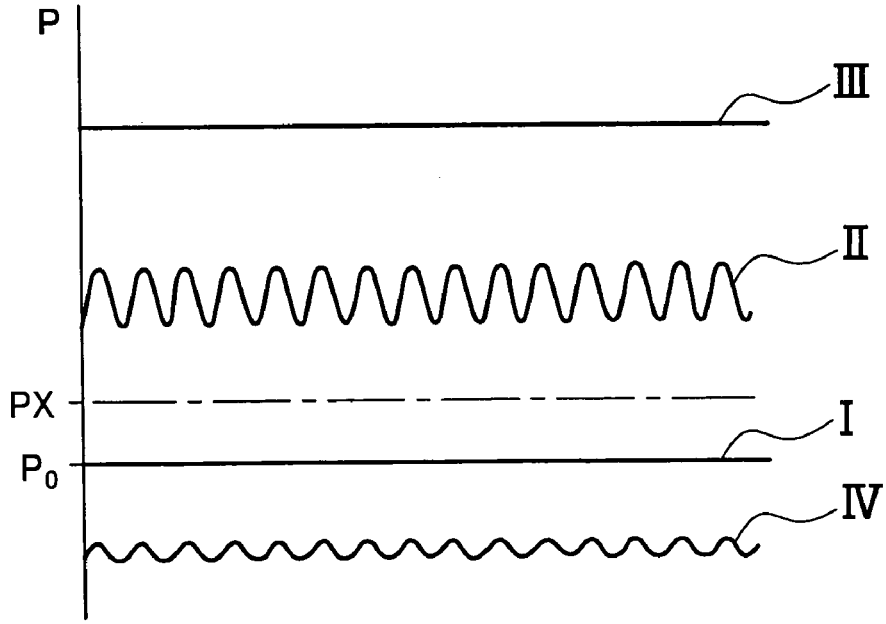
FIG. 3 is a graph indicating changes in the pressure applied to the pressure sensor.

When the engine is started, the secondary-air supply control device 10 operates to supply secondary air into exhaust gas so as to inhibit unburned HC from being discharged into the atmosphere and promote early warm-up of a catalyst. In this case, various problems may occur if the air pump 11 or the switch valve 15 is at fault, and therefore, it is determined from the output voltage of the pressure sensor 36 whether the air pump 11 and the switch valve 15 operate normally. FIG. 3 shows changes in the absolute pressure P applied to the pressure sensor 36 in the secondary-air supply passage 13 when the air pump 11 is actuated or stopped, and the switch valve 15 is opened or closed. In FIG. 3, $P_0$ represents atmospheric pressure.

When the air pump 11 is stopped and the switch valve 15 is closed, the absolute pressure P in the secondary-air supply passage 13 is equal to the atmospheric pressure $P_0$ as indicated by I in FIG. 3. When the air pump 11 is actuated and the switch valve 15 is opened, on the other hand, the absolute pressure P in the secondary-air supply passage 13 varies in a pressure range higher than the atmospheric pressure $P_0$ as indicated by II in FIG. 3 since the secondary air is supplied while being influenced by exhaust pulsation.

When the air pump 11 is actuated and the switch valve 15 is closed, the absolute pressure P in the secondary-air supply passage 13 is held at a constant pressure level higher than the varying pressure II, as indicated by III in FIG. 3. When the air pump 11 is stopped and the switch valve 15 is opened, the absolute pressure P in the secondary-air supply passage 13 varies in a pressure range lower than the atmospheric pressure $P_0$, as indicated by IV in FIG. 3, since negative pressures are periodically developed in the exhaust branch pipes 8 due to exhaust pulsation.

If the air pump 11 is stopped when the secondary air is to be supplied, for example, the pressure as indicated by I or IV in FIG. 3 is developed in the secondary-air supply passage 13 although the pressure should appear as indicated by II in FIG. 3. In this case, a threshold value PX slightly higher than the atmospheric pressure $P_0$ is established, and it is determined whether the air pump 11 operates normally, depending upon whether the pressure in the secondary-air supply passage 13 is higher or lower than the threshold value PX.

In order to make fault diagnosis based on the magnitude of the absolute pressure P as described above, it is required to accurately detect a reference pressure, namely, the output voltage of the pressure sensor 36 which represents atmospheric pressure. If the output voltage of the pressure sensor 36 detected when the battery voltage is temporarily reduced is determined as an output voltage representing atmospheric pressure, this output voltage representing atmospheric pressure deviates from a correct value when the nominal battery voltage is restored, and the fault diagnosis cannot be correctly performed.

In the present embodiment, therefore, when the battery voltage is lower than a predetermined permissible voltage, the output value of the pressure sensor 36 is inhibited from being used as an output value representing atmospheric pressure. In the following, this will be explained in greater detail referring to FIG. 4 through FIG. 7.

FIG. 4 through FIG. 7 show the time at which the ignition switch 32 is turned on, the time at which the starter switch is turned on, changes in the engine speed N, the time at which the air pump 11 is switched on or actuated, changes in the battery voltage E, atmospheric pressure $P_0$ detected by and retrieved from the pressure sensor 36, and the time at which a retrieval completion flag indicating that retrieval of the atmospheric pressure is completed is set. In each of FIG. 4 through FIG. 7, changes in the count value or values of one or more counters C1, C2, C3 used under the situation of each figure are also shown.

In the present embodiment of the invention, a retrieving action for retrieving the output voltage of the pressure sensor 36 is started after a lapse of waiting time $\Delta t_1$ from turn-on of the ignition switch 32 to a rise of the battery voltage E applied to the pressure sensor 36 and other components. This is a common feature in all of the cases illustrated in FIG. 4 through FIG. 7.

Figure 4:
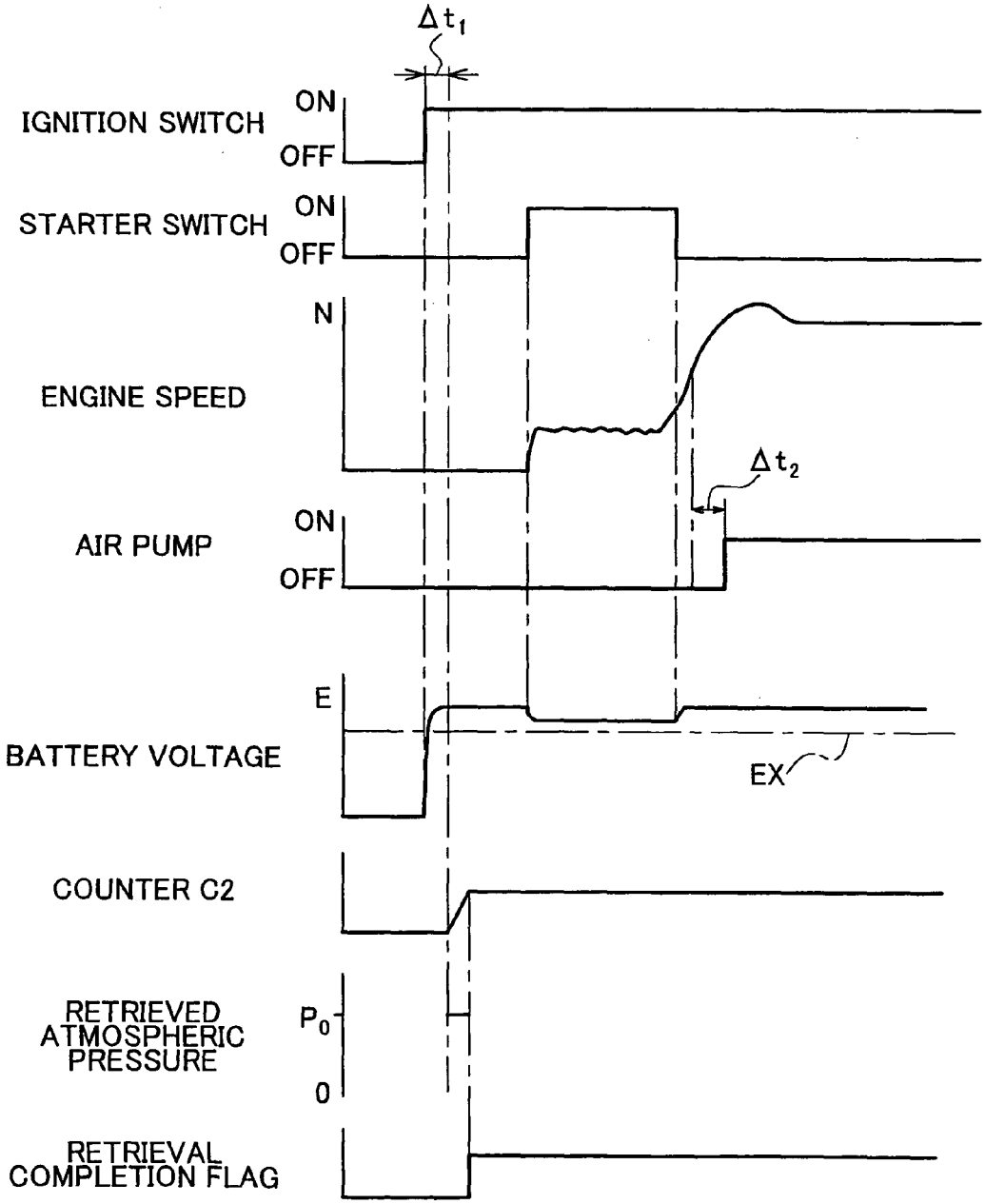
FIG. 4 is a time chart illustrating one example of changes in the battery voltage and others during startup of the engine.
Figure 5:
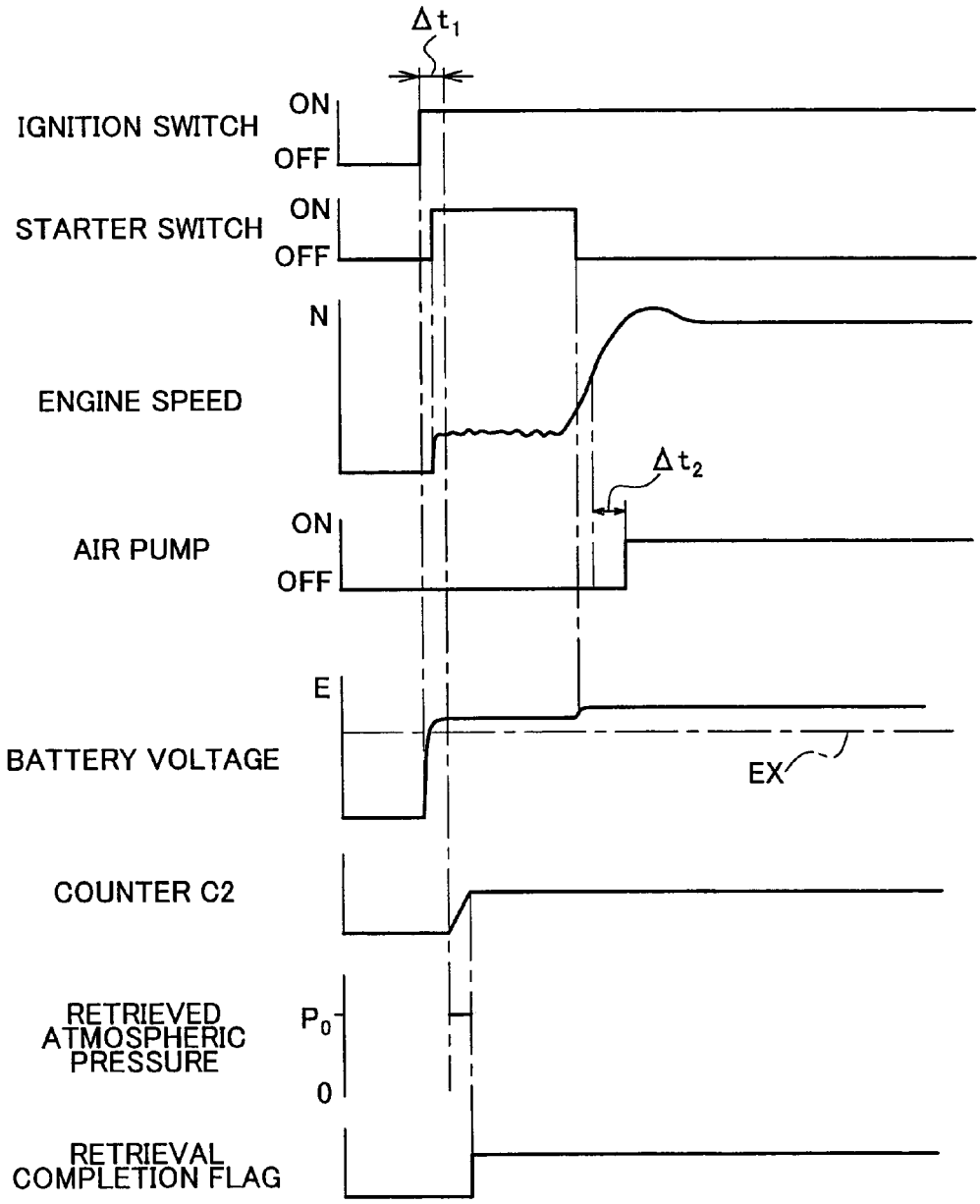
FIG. 5 is a time chart illustrating another example of changes in the battery voltage and others during startup of the engine.
Figure 6:
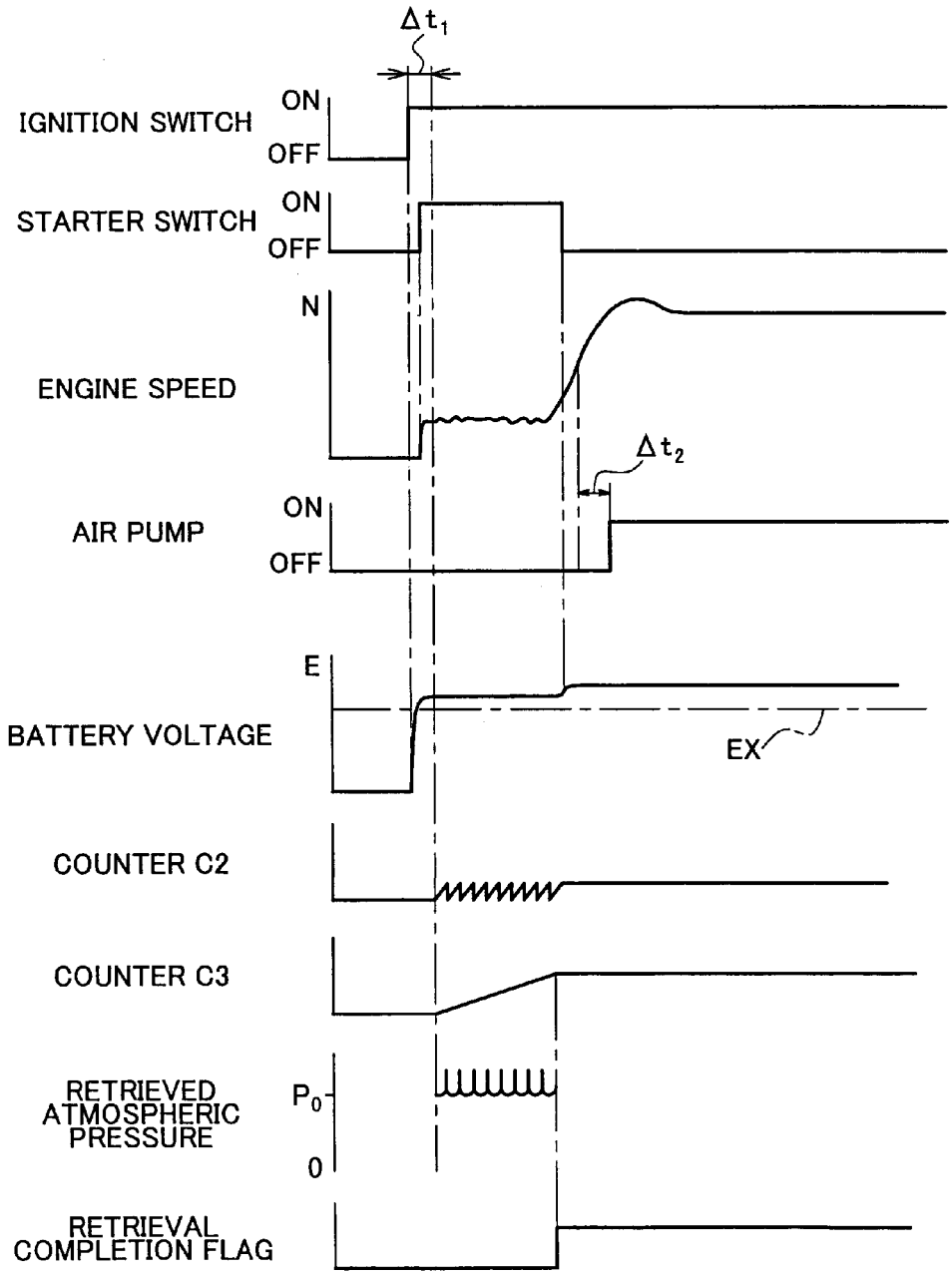
FIG. 6 is a time chart illustrating a further example of changes in the battery voltage and others during startup of the engine.

FIG. 4 through FIG. 6 show the case where the battery voltage E is not reduced to be lower than a predetermined permissible voltage EX even when the starter motor, for example, is actuated. In this case, retrieval of the output voltage of the pressure sensor 36 is started immediately after the expiration of the above-mentioned waiting time $\Delta t_1$. Also in this case, after the starter switch is turned on, the air pump 11 is actuated or started after a lapse of a predetermined, fixed time $\Delta t_2$ measured from the time when the engine speed N reaches, for example, 400 rpm or higher, namely, the engine starts operating by itself, so that supply of secondary air is started.

FIG. 4 shows a typical case where the starter switch is turned on with a little time delay after the ignition switch 32 is turned on. In this case, after the expiration of the waiting time $\Delta t_1$, the output voltage of the pressure sensor 36 is retrieved a plurality of times until the count value of the counter C2 reaches a specified value, for example, 200 msec., and the output voltage last retrieved from the pressure sensor 36, for example, is determined as an output voltage representing atmospheric pressure $P_0$. Once the output voltage representing the atmospheric pressure $P_0$ is determined, the retrieval completion flag is set.

FIG. 5 and FIG. 6 show the case where the starter switch is turned on almost concurrently with or immediately after turn-on of the ignition switch 32. If the starter motor is driven, noise is superimposed or put on the output voltage of the pressure sensor 36, and the resulting output voltage of the pressure sensor 36 may not coincide with the output voltage that correctly represents atmospheric pressure. FIG. 5 shows the case where the noise put on the output voltage of the pressure sensor 36 is small, namely, the case where the amount of variation of the output voltage of the pressure sensor 36 is kept equal to or smaller than a predetermined permissible amount of variation, for a predetermined period of time, e.g., 200 msec., up to the time when the count value of the counter C2 reaches the specified value. In this case, the output voltage last retrieved from the pressure sensor 36, for example, is determined as the output voltage representing the atmospheric pressure.

On the other hand, FIG. 6 shows the case where the noise put on the output voltage of the pressure sensor 36 when the starter motor is actuated is large, namely, the case where the amount of variation of the output voltage of the pressure sensor 36 does not become equal to or smaller than the predetermined permissible amount of variation, for the predetermined period of time, e.g., 200 msec., up to the time when the count value of the counter C2 reaches the specified value. In this case, after a lapse of the waiting time $\Delta t_1$, the output voltage of the pressure sensor 36 is retrieved a plurality of times until the count value of the counter C3 reaches a specified value, for example, 1000 msec., and an average value of these output voltages of the pressure sensor 36 is determined as the output voltage representing the atmospheric pressure.

In this case, however, if the air pump 11 is actuated or started before the count value of the counter C3 reaches the specified value, an average value of the output voltages of the pressure sensor 36 retrieved until the air pump 11 is actuated is determined as the output voltage representing the atmospheric pressure.

Figure 7:
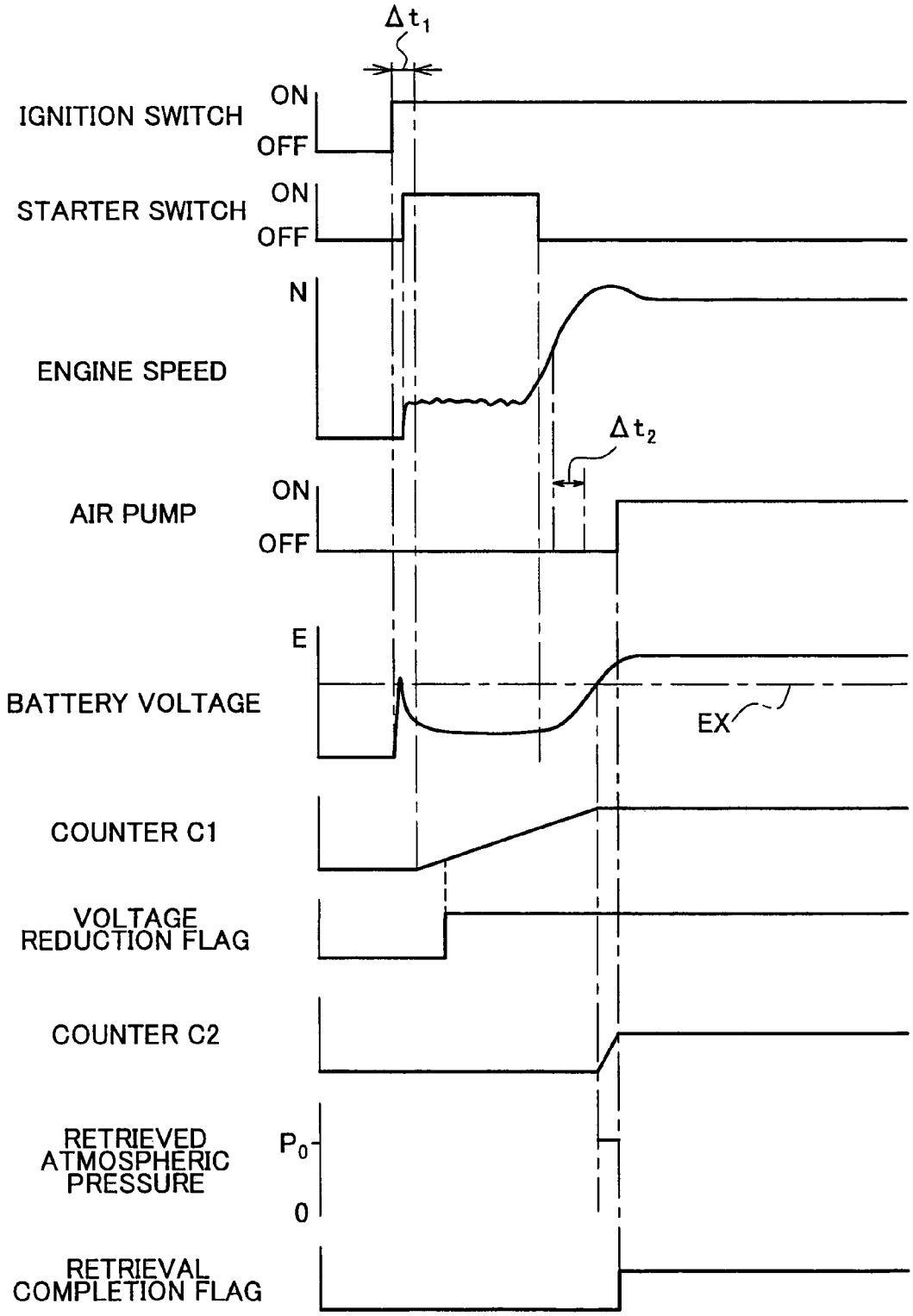
FIG. 7 is a time chart illustrating a still another example of changes in the battery voltage and others during startup of the engine.

FIG. 7 also shows the case where the starter switch is turned on almost concurrently with or immediately after turn-on of the ignition switch 32. In the case of FIG. 7, however, the battery voltage E measured immediately after the ignition switch 32 is turned on is lower than the predetermined permissible voltage EX. Where the battery voltage E is lower than the permissible voltage EX, the retrieving action for retrieving the output voltage of the pressure sensor 36 is not carried out, as is understood from FIG. 7. Namely, when the battery voltage E is lower than the permissible voltage EX, the output value of the pressure sensor 36 is inhibited from being used as an output value representing atmospheric pressure.

If the nominal battery voltage E is restored, namely, if the battery voltage E is increased to be higher than the permissible voltage EX, as shown in FIG. 7, the output voltage of the pressure sensor 36 is retrieved until the count value of the counter C2, for example, reaches a specified value, and the retrieval completion flag is set when the output-voltage retrieving action is completed. Namely, when the battery voltage E exceeds the permissible voltage EX after the output value of the pressure sensor 36 is inhibited from being used as the output value representing the atmospheric pressure, the output value of the pressure sensor 36 is used as the output value representing the atmospheric pressure.

When the battery voltage E is lower than the permissible voltage EX after the lapse of the waiting time $\Delta t_1$ as shown in FIG. 7, the counter C1 starts counting up, and a voltage reduction flag indicating that the battery voltage E has been reduced to be lower than the permissible voltage EX is set when the count value of the counter C1 reaches a specified value, e.g., 200 msec. Once the voltage reduction flag is set, the operation of the air pump 11 is stopped until the retrieval completion flag is set, and the air pump 11 is actuated so as to start supply of secondary air only after the retrieval completion flag is set.

Namely, supply of secondary air is stopped when the battery voltage E is lower than the permissible voltage EX immediately after the ignition switch 32 is turned on, and supply of secondary air is started after the battery voltage E exceeds the permissible voltage Ex and the output value of the pressure sensor 36 representing the atmospheric pressure is determined.

Figure 8:
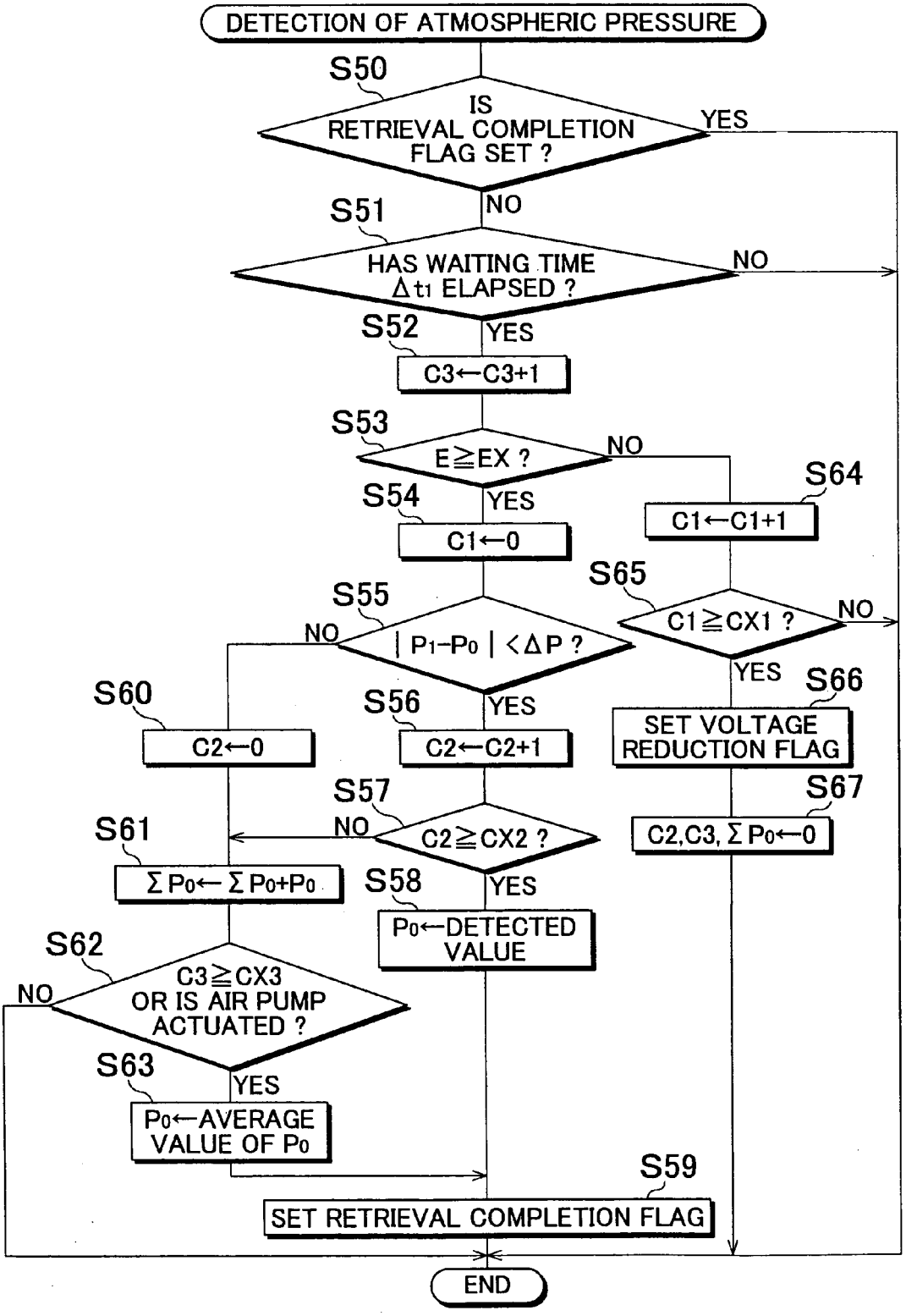
FIG. 8 is a flowchart illustrating a routine for detecting atmospheric pressure.

FIG. 8 illustrates a routine for detecting atmospheric pressure. This routine is executed as an interrupt routine at intervals of a fixed time, for example, 4 msec. Referring to FIG. 8, step 50 is initially executed to determine whether the retrieval completion flag is set. When the retrieval completion flag is set, the current cycle of the routine is finished. When the retrieval completion flag is not set, namely, when the output value of the pressure sensor 36 representing atmospheric pressure has not been determined, the control proceeds to step 51.

In step 51, it is determined whether the waiting time $\Delta t_1$ has elapsed since the ignition switch 32 is turned on. If the waiting time $\Delta t_1$ has not elapsed, the current cycle of the routine is finished. If the waiting time $\Delta t_1$ has elapsed, the control proceeds to step 52. In step 52, the count value of the counter C3 is incremented. In the following step 53, it is determined whether the battery voltage E is equal to or higher than the permissible voltage EX. If $E \geqq EX$, namely, if the battery voltage E is equal to or higher than the permissible voltage EX, the control proceeds to step 54 to clear or reset the counter C1, and then proceeds to step 55.

In step 55, it is determined whether an absolute value of a pressure difference $(P_1-P_0)$ between the atmospheric pressure $P_1$ detected by the pressure sensor 36 in the last cycle and the atmospheric pressure $P_0$ detected by the pressure sensor 36 in the current cycle is lower than a predetermined permissible pressure difference $\Delta P$. If $|P_1-P_0|<\Delta P$, namely, if the amount of variation of the output voltage of the pressure sensor 36 is smaller than the permissible amount of variation, the control proceeds to step 56 to increment the count value of the counter C2. In the following step 57, it is determined whether the count value of the counter C2 has reached a specified value CX2, for example, whether a period of 200 msec. has elapsed. If $C2 \geqq CX2$, the control proceeds to step 58 to determine the atmospheric pressure $P_0$ from the output voltage of the pressure sensor 36. The control then proceeds to step 59 to set the retrieval completion flag. This case is illustrated in FIG. 4 or FIG. 5.

Namely, in the case as shown in FIG. 4 and described above, when the output value of the pressure sensor 36 is held constant for a predetermined period of time while the battery voltage E is kept higher than or equal to the permissible voltage EX immediate after the ignition switch 32 is turned on, the output value of the pressure sensor 36 is determined as an output value representing atmospheric pressure.

As described above, the output value of the pressure sensor 36 may be retrieved during cranking immediately after the ignition switch 32 is turned on. In this case, noise is superimposed on the output voltage of the pressure sensor 36, and therefore, the output voltage of the pressure sensor 36 may vary or fluctuate. In this case, according to the present embodiment of the invention, when the output value of the pressure sensor 36 varies or fluctuates while the battery voltage E is higher than or equal to the permissible voltage EX, the output value of the pressure sensor 36 representing atmospheric pressure is determined depending upon the magnitude of variation of the output value. FIG. 5 shows the case where the amount of variation of the output voltage of the pressure sensor 36 is small.

Namely, in the case as shown in FIG. 5 and described above, the output value of the pressure sensor 36 is determined as an output value representing atmospheric pressure when the amount of variation of the output value of the pressure sensor 36 is kept smaller than the predetermined permissible amount of variation for the predetermined period of time.

Referring back to FIG. 8, when it is determined in step 55 that $|P_1-P_0|\geqq\Delta P$, namely, when the amount of variation of the output voltage of the pressure sensor 36 is equal to or larger than the predetermined permissible amount of variation, the control proceeds to step 60 to clear the counter C2. In the following step 61, the atmospheric pressure $P_0$ detected by the pressure sensor 36 is added to the sum $\Sigma P_0$ of atmospheric pressures that have been detected. If $|P_1-P_0|$ becomes smaller than $\Delta P$ (i.e., $|P_1-P_0|<\Delta P$) after it was determined that $|P_1-P_0|\geqq\Delta P$, the control proceeds to step 61 unless it is determined in step 57 that C2≧CX2, namely, unless $|P_1-P_0|$ is kept smaller than $\Delta P$ for a specified period of time (=CX2).

After the sum $\Sigma P_0$ is calculated in step 61, the control proceeds to step 62 to determine whether the count value of the counter C3 has reached a specified value CX3, or whether the air pump 11 is actuated or started. If the count value of the counter C3 reaches the specified value CX3, for example, 1000 msec. has elapsed after a lapse of the waiting time $\Delta t_1$, or the air pump 11 is actuated, an average value of atmospheric pressure is calculated from the sum $\Sigma P_0$ in step 63, and the thus obtained average value is determined as atmospheric pressure $P_0$. This case is illustrated in FIG. 6.

Namely, in the case as shown in FIG. 6 and described above, if the amount of variation of the output value of the pressure sensor 36 is not kept smaller than the predetermined permissible amount of variation for the predetermined period of time, the average value of the output values of the pressure sensor 36 is determined as an output value representing atmospheric pressure. In this case, the output value of the pressure sensor 36 representing the atmospheric pressure is determined before supply of secondary air is started.

If it is determined in step 53 that the battery voltage E is lower than the permissible voltage EX, the control proceeds to step 64 to increment the count value of the counter C1. In the following step 65, it is determined whether the count value of the counter C1 has reached a specified value CX1, for example, whether 200 msec. has elapsed since it was determined that E<EX. If the count value of the counter C1 exceeds the specified value CX1, the control proceeds to step 66 to set the voltage reduction flag. In the following step 67, the counter C2, counter C3 and the sum $\Sigma P_0$ are cleared. This case is illustrated in FIG. 7.

Figure 9:
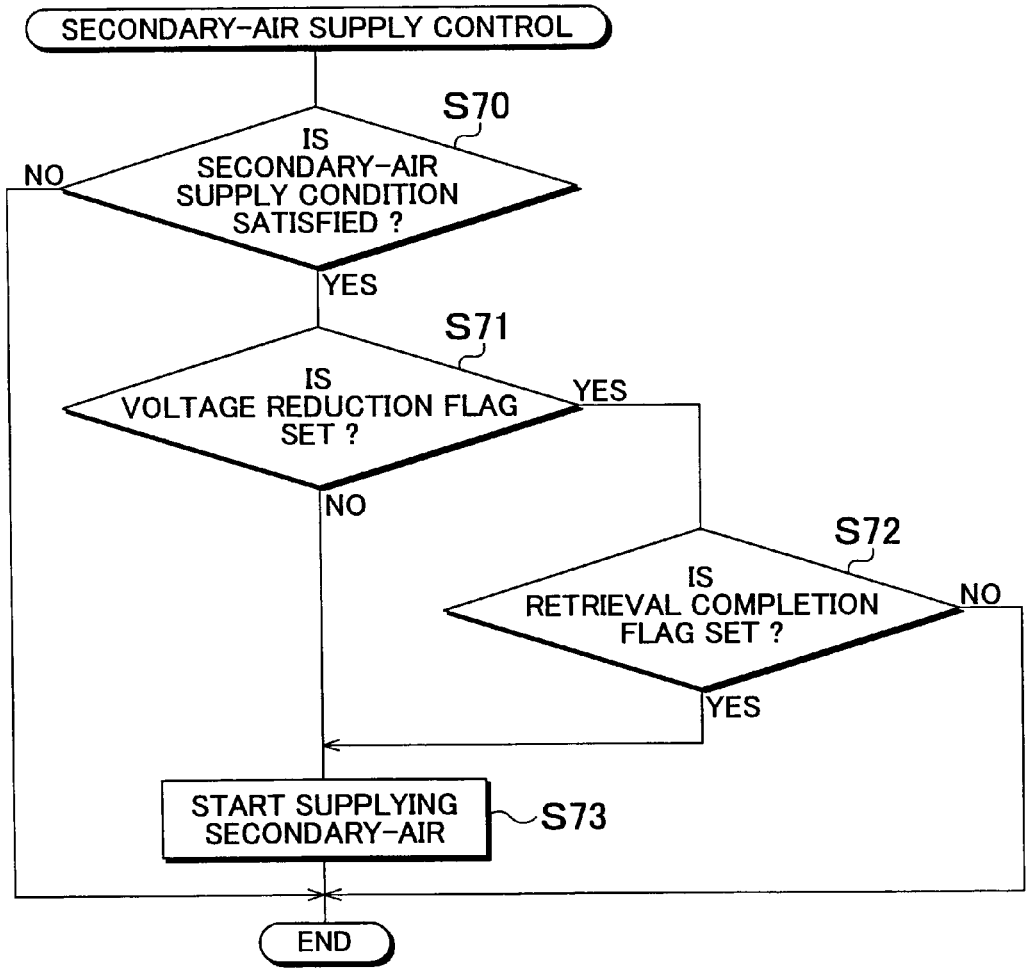
FIG. 9 is a flowchart illustrating a routine for performing secondary-air supply control.

If the voltage reduction flag is set, supply of secondary air is delayed as shown in FIG. 7 according to a secondary-air supply control routine as shown in FIG. 9. The secondary-air supply control routine of FIG. 9 is also executed as an interrupt routine at intervals of a fixed time, for example, 4 msec. Referring to FIG. 9, it is initially determined in step 70 whether a secondary-air supply condition is satisfied. In the examples shown in FIG. 4 through FIG. 7, the secondary-air supply condition is determined as being satisfied when the specified time $\Delta t_2$ has elapsed after the engine starts operating by itself. If the secondary-air supply condition is not satisfied, the current cycle of the routine is finished.

If the secondary-air supply condition is satisfied, on the other hand, the control proceeds to step 71 to determine whether the voltage reduction flag is set. If the voltage reduction flag is not set, namely, if the battery voltage E is not kept smaller than the permissible voltage EX for a specified period of time or longer, the control proceeds to step 73 to immediately start supply of secondary air. If the voltage reduction flag is set, on the other hand, the control proceeds to step 72 to determine whether the retrieval completion flag is set. If the retrieval completion flag is set, supply of secondary air is started. Namely, once the voltage reduction flag is set, supply of secondary air is started only after the output voltage of the pressure sensor 36 representing the atmospheric pressure is determined.

Needless to say, the present invention may find applications other than fault diagnosis of the secondary-air supply control device.

While the invention has been described with reference to exemplary embodiments thereof, it is to be understood that the invention is not limited to the described embodiments or constructions. To the contrary, the invention is intended to cover various modifications and equivalent arrangements. In addition, while the various elements of the exemplary embodiments are shown in various combinations and configurations, other combinations and configurations, including more, less or only a single element, are also within the spirit and scope of the invention.

The invention claimed is:

1. An internal combustion engine comprising a battery; and a pressure sensor to which a battery voltage is applied from the battery, which produces an output responsive to a pressure, the output value of the pressure sensor changes in accordance with a reduction in the battery voltage, wherein a controller inhibits the output value of the pressure sensor from being used as an output value representing the pressure, at a time immediately after an ignition switch is turned on when a fault diagnosis is performed when the battery voltage is lower than a predetermined permissible voltage, and wherein when the output value of the pressure sensor varies while the battery voltage is higher than the predetermined permissible voltage immediately after the ignition switch is turned on, said controller determines the output value of the pressure sensor representing atmospheric pressure depending upon a magnitude of variation of the output value.

2. The internal combustion engine according to claim 1, wherein when the battery voltage is lower than the predetermined permissible voltage immediately after the ignition switch is turned on, said controller inhibits the output value of the pressure sensor from being used as an output value representing atmospheric pressure.

3. The internal combustion engine according to claim 2, wherein when the battery voltage exceeds the predetermined permissible voltage after the output value of the pressure sensor is inhibited from being used as the output value representing atmospheric pressure, said controller uses the output value of the pressure sensor as the output value representing atmospheric pressure.

4. The internal combustion engine according to claim 1, wherein when the output value of the pressure sensor is held constant for a predetermined period of time while the battery voltage is higher than the predetermined permissible voltage immediately after the ignition switch is turned on, said controller determines the output value of the pressure sensor as an output value representing atmospheric pressure.

5. The internal combustion engine according to claim 1, wherein when an amount of variation of the output value of the pressure sensor is kept equal to or smaller than a predetermined permissible amount of variation for a predetermined period of time, said controller determines a final value of the output values of the pressure sensor as the output value representing atmospheric pressure.

6. The internal combustion engine according to claim 1, wherein when an amount of variation of the output value of the pressure sensor is kept larger than a predetermined permissible amount of variation for a predetermined period of time, said controller determines an average value of the output values of the pressure sensor as the output value representing atmospheric pressure.

7. The internal combustion engine according to claim 1, wherein said controller controls the output value of the pressure sensor to be retrieved during cranking.

8. The internal combustion engine according to claim 1, further comprising a secondary-air supply passage connected to an engine exhaust passage, and an air pump operable to supply secondary air into the engine exhaust passage via the secondary-air supply passage, wherein:

the pressure sensor is disposed in the secondary-air supply passage; and said controller stops supply of the secondary air when the battery voltage is lower than the predetermined permissible voltage immediately after the ignition switch is turned on, and starts supply of the secondary air after the battery voltage exceeds the permissible voltage and the output value of the pressure sensor representing atmospheric pressure is determined.

9. The internal combustion engine according to claim 8, wherein when the battery voltage is higher than the predetermined permissible voltage immediately after the ignition switch is turned on, said controller starts supply of the secondary air upon a lapse of a predetermined period of time after startup of the engine, and determines the output value of the pressure sensor representing atmospheric pressure before supply of the secondary air is started.

10. A method of controlling an internal combustion engine including a battery, and a pressure sensor to which a battery voltage is applied from the battery and which produces an output responsive to a pressure, wherein an output value of the pressure sensor changes in accordance with a reduction in the battery voltage, the method comprising:

inhibiting the output value of the pressure sensor from being used as an output value representing the pressure at the time when a fault diagnosis is performed when the battery voltage is lower than a predetermined permissible voltage, and determining, when the output value of the pressure sensor varies while the battery voltage is higher than the predetermined permissible voltage immediately after the ignition switch is turned on, the output value of the pressure sensor representing atmospheric pressure depending upon a magnitude of variation of the output value.

11. The method according to claim 10, wherein the inhibiting occurs when the battery voltage is lower than the predetermined permissible voltage immediately after an ignition switch is turned on.

12. The method according to claim 11, wherein when the battery voltage exceeds the predetermined permissible voltage after the output value of the pressure sensor is inhibited from being used as the output value representing atmospheric pressure, said method further comprises:

determining the output value of the pressure sensor as the output value representing atmospheric pressure.

13. The method according to claim 10, wherein when the output value of the pressure sensor is held constant for a predetermined period of time while the battery voltage is higher than the predetermined permissible voltage immediately after the ignition switch is turned on, said method further comprises:

determining the output value of the pressure sensor as an output value representing atmospheric pressure.

14. The method according to claim 10, wherein when an amount of variation of the output value of the pressure sensor is kept equal to or smaller than a predetermined permissible amount of variation for a predetermined period of time, said determining includes determining a final value of the output values of the pressure sensor as the output value representing atmospheric pressure.

15. The method according to claim 10, wherein when an amount of variation of the output value of the pressure sensor is kept larger than a predetermined permissible amount of variation for a predetermined period of time, said determining includes determining an average value of the output values of the pressure sensor as the output value representing atmospheric pressure.

16. The method according to claim 10, further comprising:

controlling the output value of the pressure sensor to be retrieved during cranking.

17. The method according to claim 10, further comprising:

stopping supply of a secondary air to a secondary-air supply passage connected to an engine exhaust passage when the battery voltage is lower than the predetermined permissible voltage immediately after the ignition switch is turned on, and starting supply of the secondary air to the secondary-air supply passage connected to the engine exhaust passage after the battery voltage exceeds the permissible voltage and the output value of the pressure sensor representing atmospheric pressure is determined.

18. The method according to claim 17, wherein when the battery voltage is higher than the predetermined permissible voltage immediately after the ignition switch is turned on, said method further comprises:

starting supply of the secondary air upon a lapse of a predetermined period of time after startup of the engine, and determining the output value of the pressure sensor representing atmospheric pressure before supply of the secondary air is started.

* * * * *